United States Patent [19]

Mahr

[11] Patent Number: 4,676,502

[45] Date of Patent: Jun. 30, 1987

[54] VARIABLE WEIGHT SUPPORT DEVICE

[76] Inventor: Larry L. Mahr, c/o 275 E. South Temple #303, Salt Lake City, Utah 84111

[21] Appl. No.: 503,731

[22] Filed: Jun. 13, 1983

[51] Int. Cl.[4] ..... A63B 13/00

[52] U.S. Cl. ..... 272/119; 272/123

[58] Field of Search ..... 272/119, 123, 117, 143, 272/93, 96; 128/87 B

[56] References Cited

U.S. PATENT DOCUMENTS

| | | | |
|---|---|---|---|
| 1,047,212 | 12/1912 | Hamilton | 272/119 |
| 2,807,260 | 9/1957 | Teufel | 128/87 B |
| 2,855,202 | 10/1958 | Kinne | 272/119 X |
| 3,322,425 | 5/1967 | Moore | 272/119 |
| 3,370,850 | 2/1968 | Moore | 272/119 |
| 3,721,216 | 3/1973 | Lippe et al. | 272/143 X |
| 3,724,846 | 4/1973 | Perrine | 272/123 X |
| 4,043,325 | 8/1977 | Ochs et al. | 128/87 B X |
| 4,272,072 | 6/1981 | Kusmer | 272/143 X |
| 4,327,908 | 4/1982 | James | 272/119 |
| 4,339,124 | 7/1982 | Vogler | 272/117 X |

FOREIGN PATENT DOCUMENTS

| | | | |
|---|---|---|---|
| 428519 | 1/1967 | Switzerland | 272/119 |

*Primary Examiner*—Richard J. Johnson

[57] ABSTRACT

A weight support worn while exercising, walking, or jogging, for holding standard disk weights at a preselected position on the upper torso region. The weight support comprises a U-shaped contoured torso base member secured around the upper chest by a strap shoulder support system. Removably attached to the base member is a cylindrical mount onto which a plurality of standard disk weights are placed. The weights are then secured to the mount with a removable keeper.

14 Claims, 4 Drawing Figures

VARIABLE WEIGHT SUPPORT DEVICE

BACKGROUND OF THE INVENTION

This invention relates to weightlifting devices, and more particularly to a weightlifting support for removably mounting a plurality of standard disk weights proximate the upper torso region.

FIELD OF THE INVENTION

This invention is directed to a weightlifting support worn on the upper body during weightlifting exercises. The device enables the wearer to support a plurality of standard disk weights proximate the upper torso region during exercises.

STATE OF THE ART

Various weightlifting supports, halters, and yokes are known. Madeuf, French No. 779.572 discloses a weight support halter to hold weights on the chest support during exercises. Perrine, U.S. Pat. No. 3,724,846 discloses a weightlifting yoke to hold the arms in a substantially vertical position while curl exercises are performed. Perrine, U.S. Pat. No. 3,679,107, discloses a lifting yoke to support weights on the shoulders while squat exercises are performed. Hamilton, U.S. Pat. No. 1,047,212, discloses a harness support for carrying a plurality of disk like weights on a vertical rod extending from a chest harness. It may also be adapted to perform other exercises such as holding weights on the top of the head. When used as a harness, the device places extreme strain on the lower back region. J. E. Moore, U.S. Pat. No. 3,322,425, discloses a weightlifting exercise shoulder harness to aid a wearer in holding weights suspended from the shoulders while performing squat exercises. J. E. Moore, U.S. Pat. No. 3,370,850, discloses another weightlifting shoulder exercise harness to aid a wearer in holding weights suspended from the shoulders while performing squat exercises. McPeak, U.S. Pat. No. 4,213,605, is a shoulder protective support device to hold weights on the shoulders of a wearer during squat exercises. Massey, U.S. Pat. No. 4,266,917, is a variably weighted vest worn for jogging, skating, bicycling, and horseback riding. The Massey vest is preferably provided with a plurality of pockets for holding materials such as sand, pebbles, small stones, coins, and the like. It enables the wearer to perform numerous exercises with variable weights. However, the vest holds heat and is not adapted to hold standard disk weights in its pocket construction. Nor does the loose fitting Massey vest provide any protection to the wearer if disk weights are placed in its pockets and flap against the user during rigorous exercises. The loose fitting Massey vest can also chafe the body during rigorous exercises.

Cited for general interest is the diver's belt method of manufacturing in Oeland, Jr., U.S. Pat. No. 3,735,598. Other weight belts are known and worn around the waist of a user while exercising. These waist belts do not wary the leverage to perform stomach exercises. Nor do they accommodate standard disk weights. Also cited for general interest is the forearm mounted support to lift arm weights in Pugh, et al, U.S. Pat. No. 4,109,908. None of the above devices are designed to support standard disk weights flush against the upper torso of the body during exercises, running, jogging, and walking.

SUMMARY OF THE INVENTION

The weightlifting support of applicant's invention provides a contoured U-shaped frontal torso base member extending across the chest of a user. The torso base member is preferably constructed of a heavy material to add weight to the upper torso region during exercises. It is of sufficient width to prevent standard disk weights affixed thereon from tilting and jabbing the wearer during rigorous exercises. It is constructed of a rigid material which will not deform when used with weights. In some embodiments, the torso base member may be constructed of a light material so that the harness does not have to be removed to perform exercises where it is not desirable to materially alter the center of gravity of a user.

The torso base member is adapted to hold a plurality of standard disk weights flush against it. Disk weights held in this manner enable a wearer to perform, without leg and arm interference, a variety of exercises such as situps, pushups, squats, and the like. The weightlifting support is suspended from the shoulders by an adjustable strap system. The adjustable straps enable the wearer to raise or lower the base member along the torso to a pre-selected point to adjust the center of gravity of the weights to increase leverage and tension while a user performs certain stomach exercises such as situps. Leverage is increased by placing the base member nearer the shoulder region. Conversely, leverage is decreased by placing the base member nearer the stomach region. The wearer can thus place the weights at a preselected point along the torso to provide desired leverage or tension for performing certain exercises.

Standard disk weights are held against the torso base member via a removable mount. The removable mount generally comprises a cylindrical rod removably attached to the base member, and structured to fit through the center hole of a standard disk weight. The cylindrical rod is of sufficient length such that a plurality of weights can be placed on it. The weights are held on the cylindrical rod via a keeper such as a weight clamp. The length of the cylindrical rod should be sufficient to hold a plurality of weights, but not unduly extend from the torso to interfere with the performance of standard exercise, such as pushups. The cylindrical rod may be removed from the torso base member to enable a wearer to perform exercises with the torso base member alone.

The weightlifting support is typically constructed such that the torso base member has a standard weight. The wearer thus knows how much weight he is initially adding for his exercise program. As a user becomes stronger and wishes to add more weight during his exercise routine, additional disk weights are then added to the removable mount. The wearer thus progressively adds more weight for performing his routines as his stamina and strength improve. With the adjustable strap system, the leverage for performing stomach exercises is also adjusted. To develop the upper stomach muscles, the base member is raised. To develop the lower stomach muscles, the base member is lowered. The lower stomach muscles and the upper stomach muscles can thus be selectively developed by raising and lowering the base member along the torso.

Generally, the adjustable strap system comprises a crisscrossed pair of shoulder straps attached to the torso base member. To insure that the torso base member is held flush against the chest area of a wearer while exercising, an additional strap may be included. This strap attaches to the ends of the torso base member and passes around the back of a wearer. The shoulder straps may be shortened or lengthened to secure the torso base member at a predetermined point selected by the wearer. The leverage placed on a wearer during exercises is thus varied by raising or lowering said torso base member by adjusting the length of the straps.

In one embodiment, the torso base member itself includes a plurality of vertically aligned holes along its width proximate the middle of the base member. The removable mount may be inserted in various holes in the base member. The center of gravity can thus be adjusted without adjusting the straps by raising or lowering the mount.

In another embodiment of the invention, a second rear torso base member is included to extend around the back of a wearer. The rear torso base member can be used to support standard disk weights to counterbalance those placed on the front of a wearer. Similar removable mounting means discussed above are associated with the rear torso base member to support disk weights on the back of a wearer. A variable strap system associated with the front torso base member and the rear torso base member is included to raise and lower both base members such that the front and rear weights are generally held parallel to one another during exercises. The ends of the front torso base member and the rear torso base member are secured flush around the torso during exercises. Typically, a hinged fastener connects the ends on one side of the base members. The ends of the other side of the base members are connected with an opening adjustable fastener such as a belt buckle system. However, other conventional connecting systems, such as hook and loop strips, may be used to removably secure the ends of the front and rear torso base members flush about a wearer. These fastener systems may include elasticized members to accommodate chest expansion movements during exercises.

In another embodiment, the front torso base member ends may be adapted to hold the upper arms in a predetermined position relative to the torso during curling exercises. Preferably, removable arm supports structured to accommodate the upper arms may be attached proximate the ends of the torso base member at a preselected position. The arm supports in one embodiment are comprised of removable bent sleeves which can be slipped over the ends of the torso base member. They are secured at a preselected variable position on the base member with retractable spring bearings in the bent sleeve which mate with a series of holes along the length of the torso base member. However, other opening fasteners such as clips and snaps can be used to secure the arm supports at a preselected position along the torso base member. Preferably, the arm supports are positioned to hold the upper arms at an angle slightly forward from vertical so that a user performing curl exercises must use the full strength of his upper arms. In this forward position, a user cannot leverage the elbows against the arm supports or bend the body for assistance in performing the exercises as with the Perrine weightlifting yoke.

Another means of positioning the arms relative the torso during curling exercises is to include a removable curling bar, such as the rigid contoured base member described in Perrine, U.S. Pat. No. 3,724,846. The curling bar is adapted to mount on the removable mount via a center hole proximate the middle of the curling bar. This curling bar can be positioned on the removable mount a distance from the torso base member by placing spacers such as disk weights therebetween. In this position, the upper arms are held at an angle equal to or less than vertical alignment with the torso in a slightly forward position. Thus, the curling bar when mounted flush against the torso base member is structured to hold the arms in a verticl position along the torso. The curling bar may then be removed and a plurality of spacers or small disk weights placed on the removable mount before adding the curling bar. With the spacers or disk weights added, the bar is extended from the chest to position the upper arms in a forward position from vertical so that a user performing curling exercises must use the full strength of his upper arm. When the user is finished with the curling exercises, the curling bar is removed from the removable mount.

Applicant's invention thus provides a general purpose weight support harness utilizing conventional disk weights. The weights are held proximate the upper torso region while exercising, running, jogging, and walking. Applicant's weight support system can be worn for performing a variety of exercises, without the necessity of removing it as a wearer performs different types of exercises. Applicant's invention enables the body to breathe while exercising, thus avoiding overheating caused by existing weighted vests. It also avoids chaffing problems associated with loose fitting weighted vests, and enables a wearer to adjust exercise leverage by changing the center of gravity of the upper torso.

DESCRIPTION OF THE ILLUSTRATED EMBODIMENTS

Figure 1:
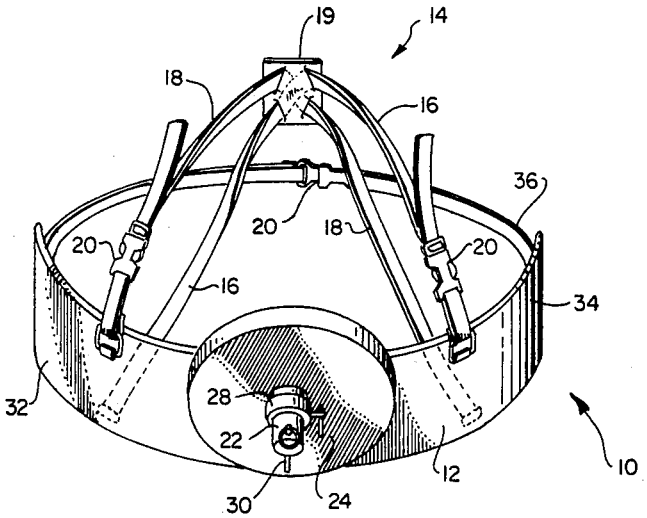
FIG. 1 is a perspective view of one embodiment of applicant's invention.

Applicant's variable weight support device 10 comprises a contoured U-shaped front torso base member 12 extending across the chest of a user. The base member 12 is held flush against the upper torso at a preselected position by means of an adjustable strap system 14 shown in FIG. 1 as a pair of crisscross straps 16, 18 attached to the base member 12 and passing over the shoulder of a wearer. A strap separater 19 may be used to prevent the straps 16, 18 from tangling. The straps 16,18 are adjusted by adjustable fasteners, e.g. combined slide fasteners 20, such as those produced under the tradename Fastex, Model SR-1 described in U.S. Pat. Nos. 4,150,464, and 417,155. The fastener 20 lengthens or shortens the straps 16, 18 to raise or lower the base member 12 along the torso to a desired position. Standard disk weights 24 are held against the base member 12 by means of a mount 22 removably attached to said base member 12. The removable mount 22 illustrated in FIG. 1 is a cylindrical rod sized to fit within the center hole of a standard disk weight 24. The mount 22 is removably attached to the base member 12 by conventional fasteners; e.g. a threaded bolt 26 (shown in FIG. 3) passing through a hole (not shown) proximate the middle of the base member 12. The threaded bolt 26 attaches to the mount 22 via a threaded hole (not shown) in the bottom of the mount 22.

The base member 12 is preferably constructed of a rigid heavy weight material, such as steel or aluminum. Thus the base member 12 alone can be worn by a user for adding additional weight to the upper torso while performing exercises. The user may then add additional weight by fastening a plurality of standard disk weights 24 to the removable mount 22. The disk weights 24 are held on the removable mount 22 by a weight clamp 28 shown in FIG. 1. To prevent accidental release of the clamp 28 during rigorous exercise, a safety release pin 30 may be included. The safety release pin shown in FIG. 1 is a pin 30 inserted within a hole (not shown) through the mount 22 and secured therein by means of a retractable spring bearing (not shown).

To insure that the base member 12 is held flush against the chest area during exercises, an adjustable back strap 36 may be included. The back strap 36 is attached to the ends 32, 34 of the base member 12, and is secured around the back of a user using conventional means, e.g. a buckle 20.

Figure 2:
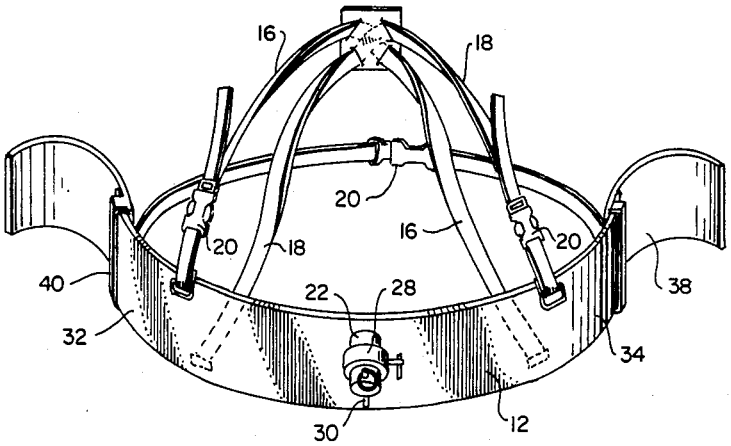
FIG. 2 is a perspective view of another embodiment of applicant's invention.

FIG. 2 illustrates another embodiment of applicant's invention 10. Removably attached to the ends 32, 34 of the base member 12 are arm supports 38 to hold the upper arms at a predetermined position along the torso during exercises such as curl lifts. The arm supports 38 are structured to slip over the ends 32, 34 of the base member 12 via loops 40. The arm supports 38 are held on the ends 32, 34 with conventional fasteners, e.g. retractable spring bearings (not shown) fitting into holes (not shown) within the loops 40 of the arm supports 38. To remove the arm supports 38, the bearings are depressed allowing the loops 40 to slide off the ends 32, 34. A user may thus perform curling exercises with the arm supports 38 attached, and then remove them to perform other exercises.

Figure 3:
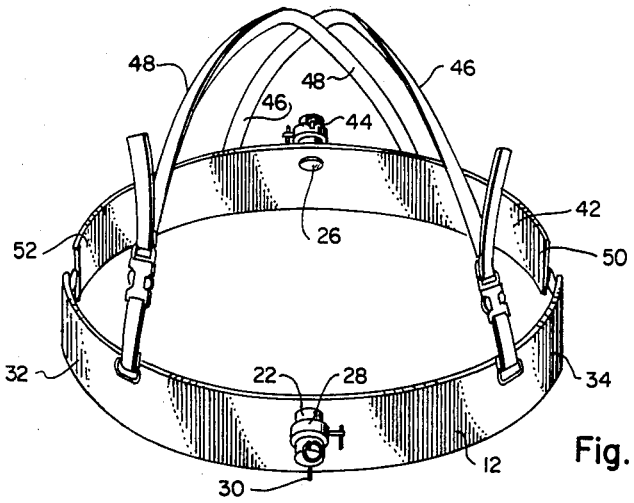
FIG. 3 is a perspective view of still another embodiment of applicant's invention.

FIG. 3 illustrates another embodiment of applicant's invention 10, including a second rear base member 42 attached to the front base member 12 and structured to encircle the back. Standard disk weights 24 can then be attached on the rear mount 44 to counter-balance weights 24 placed on the front base member 12. The front base member 12 and the rear base member 42 are supported from the shoulders using two straps 46,48 attached at the ends 32,34, and 50, 52 of the base members 12,42. The base members 12, 42 are hingedly removably connected with hook and loop strips (not shown) attached to join ends 32, 52 together, and ends 34, 50 together.

By counter-balancing weights on the front and back of the upper torso, rigorous exercises such as jogging can be performed more readily. The weight capacity of a single base member 12 can also be doubled by adding the second base member 42 for performing more strenuous leg exercises such as squats.

Thus, applicant's invention 10 offers a weight support system for performing a wide variety of exercises without having to remove the support system. It also allows heat to escape during strenuous exercising to prevent overheating. The device 10 is comfortable to wear and does not interfere with arm or leg movement. It also can be used to vary the center of gravity of a user performing exercises.

Figure 4:
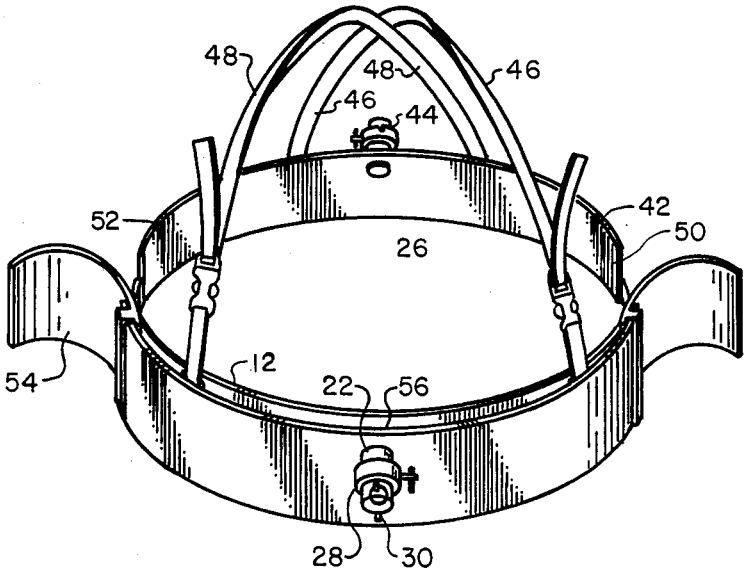
FIG. 4 is a perspective view of still another embodiment of applicant's invention.

FIG. 4 illustrated applicant's invention with a Perrine type curling bar 54 attached to the center mount 22. Spacers 56 are first inserted over the center mount 22 and then a curling bar 54 is inserted over the mount and secured thereon with the weight clamp 28.

Although this specification has made reference to the illustrated embodiments, it is not intended to restrict the scope of the appended claims. The claims themselves recite those features regarded as essential to the invention.

I claim:

1. A weight support adapted to be worn on the upper torso during exercises comprising:

a contoured U-shaped torso base member adapted to extend laterally across the chest of a user and terminate in rearwardly extending free ends;

an adjustable strap system attached to the base member to removably hold said base member to the upper torso at a preselected position to alter the center of gravity of a user; and a forwardly positioned generally horizontally extending mount removably attached to the base member, said mount adapted to hold a plurality of standard disk weights flush against the base member.

2. A weight support according to claim 1 wherein the removable mount comprises:

a cylindrical rod with one end adapted to removably attach to the base member at a preselected position on said base member, said rod having a cross sectional diameter less than the center hole of standard disk weights such that the disk weight can be slid via the center hole on and off the cylindrical rod, and a keeper associated with the cylindrical rod to removably secure disk weights on the cylindrical rod.

3. A weight support according to claim 2, wherein the base member defines a plurality of vertically aligned holes proximate the middle of the base member into which the end of the cylindrical rod is adapted to removably mount.

4. A weight support according to claim 1, including removably mountable arm supports attached to the base member adapted to hold the upper arms of a wearer in a predetermined position relative to the torso during exercises.

5. A weight support according to claim 4, wherein the arm supports are structured as bent U-shaped sleeves to hold the upper arms toward the front of a wearer along the upper torso at an angle less than vertical.

6. A weight support according to claim 1, wherein the base member is of sufficient width to prevent disk weights mounted thereon from tilting and jabbing a wearer while exercising.

7. A weight support according to claim 1, wherein the torso base member has a first and second free end, and the adjustable strap system comprises:

a pair of straps, the first strap having a first tip and a second tip, the first tip attached to the bottom of the base member proximate its first end, and the second tip adjustably attached to the top of the base member proximate its second end forming a loop passing over one shoulder and across the back of a user, the second strap having a third tip and a fourth tip, the third tip attached to the bottom of the base member proximate its second end, and the fourth tip adjustably attached to the top of the base member proximate its first end forming a loop passing over the other shoulder and across the back of the user forming a crisscross pattern across the back of a wearer; and means associated with the first and second straps to adjust the length of the straps.

8. A weight support device according to claim 7, wherein the means to adjust the straps comprise: buckles associated with the second and fourth tips of the straps.

9. A weight support adapted to be worn on the upper torso during exercises comprising:

a contoured U-shaped front torso base member extending across the chest of a user;

a frontal generally horizontally extending mount removably attached to the front torso base member and adapted to hold a plurality of standard disk weights proximate the chest;

a contoured U-shaped rear torso base member extending across the back of a user;

means to secure the front and rear torso base members to encircle the upper torso;

a rear mount removable attached to the rear torso base member and adapted to hold a plurality of standard disk weights proximate the upper back; and an adjustable strap system attached to the front and rear torso base members to hold said base members at a preselected position on the torso to alter the center of gravity of the user.

10. A weight support according to claim 9 wherein the means to connect the base members comprise hook and loop straps attached to the corresponding ends of the front and rear torso base members.

11. A weight support according to claim 9 including elastic members associated with the means to secure the front and rear torso base members about the upper torso to accommodate chest breathing movement.

12. A weight support for holding standard disk weights in a preselected position on the upper torso comprising:

a U-shaped contoured torso base member adapted to extend laterally around the chest and terminate in rearwardly extending free ends;

a variable strap shoulder support system attached to the base member to secure said base member to the upper torso to alter the center of gravity of a user;

a forwardly positioned horizontally extending cylindrical mount removably attached to the base member onto which a plurality of disk weights may be placed; and a keeper to removably secure said disk weights to the mount.

13. A weight support according to claim 12, including a curling arm support bar comprising: said base member having a pair of removably secured ends extending one on each side of the user terminating at his back, each end of said member comprising a bent portion extending laterally from said end outward away from said member for fitting behind the upper arm of a user, and having a center hole for removably mounting the cylindrical mount.

14. A weight support according to claim 13 including a plurality of spacers removably mountable onto the cylindrical mount and placed between the curling arm support bar and the torso base member to extend the curling bar a predetermined distance from the base member such that the upper arms are held in a predetermined forward position.

* * * * *